United States Patent [19]

Oba et al.

[11] Patent Number: 4,886,030

[45] Date of Patent: Dec. 12, 1989

[54] METHOD OF AND SYSTEM FOR CONTROLLING FUEL INJECTION RATE IN AN INTERNAL COMBUSTION ENGINE

[75] Inventors: Hidehiro Oba, Aichi; Senji Kato, Toyota, both of Japan

[73] Assignee: Toyota Jidosha Kabushiki Kaisha, Aichi, Japan

[21] Appl. No.: 162,942

[22] Filed: Feb. 26, 1988

[30] Foreign Application Priority Data

Mar. 5, 1987 [JP] Japan ..... 62-51056

[51] Int. Cl.[4] ..... F02D 41/32; F02D 43/00

[52] U.S. Cl. ..... 123/488; 123/417; 123/422; 123/423; 123/492; 123/493; 123/494

[58] Field of Search ..... 123/492, 493, 478, 480, 123/486, 488, 494, 422, 423, 417

[56] References Cited

U.S. PATENT DOCUMENTS

| | | | |
|---|---|---|---|
| 4,172,433 | 10/1979 | Bianchi et al. | 123/486 |
| 4,388,906 | 6/1983 | Sugiyama et al. | 123/492 |
| 4,499,881 | 2/1985 | Takao | 123/492 |
| 4,750,352 | 6/1988 | Kolhoff | 123/480 |
| 4,785,785 | 11/1988 | Oba et al. | 123/488 |

FOREIGN PATENT DOCUMENTS

| | | | |
|---|---|---|---|
| 56-47638 | 4/1981 | Japan . | |
| 58-8238 | 1/1983 | Japan . | |
| 58-206845 | 12/1983 | Japan | 123/492 |
| 59-28031 | 2/1984 | Japan . | |
| 60-169647 | 9/1985 | Japan . | |
| 60-224951 | 11/1985 | Japan . | |
| 2145470 | 3/1985 | United Kingdom | 123/492 |

*Primary Examiner*—Andrew M. Dolinar
*Attorney, Agent, or Firm*—Oliff & Berridge

[57] ABSTRACT

A method for controlling fuel injection rate in internal combustion engine in accordance with the intake pressure and the engine speed. The method has the steps of determining the intake pressure using, as a variable, the period of time after a change in the throttle opening, and computing a basic fuel injection period on the basis of the thus computed intake pressure and the engine speed. The fuel injection is conducted by a system in accordance with this method. The system determines the intake pressure in the steady state of engine operation in accordance with the throttle opening and the fuel injection rate, effects a correction on the thus determined intake pressure so as to take into account a delay in response of the intake pressure to the transient period, and determines the basic fuel injection period on the basis of the corrected intake pressure and the engine speed. With this method and system, the fuel injection rate can be controlled in a high degree of conformity with the injection rate demanded by the engine, because the injection rate is determined on the basis of the engine speed and the actual intake pressure which can be predicted with a high degree of precision.

20 Claims, 15 Drawing Sheets

METHOD OF AND SYSTEM FOR CONTROLLING FUEL INJECTION RATE IN AN INTERNAL COMBUSTION ENGINE

BACKGROUND OF THE INVENTION

1. Field of the Invention

The present invention relates to a method of and an apparatus for controlling fuel injection rate in an internal combustion engine. More particularly, the present invention is concerned with a method of and an apparatus for controlling fuel injection rate in an internal combustion engine on the basis of a basic fuel injection period which is determined in accordance with the intake pressure and speed of the engine.

2. Description of the Related Art

In the field of fuel injection-type internal combustion engines, fuel injection rate controlling systems have been known as having steps of detecting the intake pressure and the speed of the engine, computing a basic fuel injection period in accordance with the intake pressure and the engine speed, determining the fuel injection period by correcting the basic fuel injection period in accordance with factors such as the intake air temperature, cooling water temperature, and so forth, and allowing a fuel injector to open for a period of time equal to the thus determined fuel injection period.

In this known system, the intake pressure is picked up by means of a diaphragm type pressure sensor which is attached to the intake pipe of the engine. The output from the pressure sensor is processed by a filter having a time constant of 3 to 5 msec for eliminating the pulsation component of the intake pressure caused by the operation of the engine. The basic fuel injection period is computed from the thus detected intake pressure and the engine speed which is sensed by a suitable engine speed sensor.

This known system has a drawback in that the detected change in the intake pressure has a certain time lag behind the actual change in the intake pressure during a transient period of engine operation, e.g., acceleration, due to a delay of response of the diaphragm of the pressure sensor and due to a delay of response attributable to the time constant of the filter. For instance, when the engine is being accelerated quickly by a quick opening of the throttle valve accompanied by a drastic rise in the intake air pressure, the detected intake pressure rises rather slowly, whereby the basic fuel injection period is computed on the basis of the intake pressure which is lower than the actual intake pressure. In consequence, the air-fuel mixture supplied to the engine becomes too lean, with the result that the response of the engine to the acceleration demand is impaired and noxious exhaust emissions are increased. Conversely, when the engine is being decelerated with the throttle valve closed quickly accompanied by a rapid reduction in the intake pressure, the basic fuel injection period is computed on the basis of the intake pressure which is higher than the actual intake pressure, with the result that the drivability of the engine is impaired due to the supply of a too rich air-fuel mixture, as well as increased noxious exhaust emissions. In order to obviate these problems attributable to the generation of a too rich or a too lean mixture, various corrections are conducted by, for example, employing acceleration increment or deceleration decrement of the fuel supply. As a matter of fact, however, it has been impossible to control the air-fuel ratio of the mixture to command levels over the entire range of the engine operation, because of the presence of the above-mentioned time lag or delay in the detection of the intake pressure in transient periods of the engine operation.

In order to eliminate any time lag in the detection, Japanese patent application Laid-Open No. 28031/1984 proposes, as a parameter of determination of the basic fuel injection period, the amount of opening of the throttle valve of the engine which inherently does not have any time lag to the change in the intake pressure. Thus, a fuel injection rate controlling system proposed by this known art is to compute the basic fuel injection period in accordance with the amount of the throttle opening and the engine speed.

In another known fuel injection rate controlling method proposed in Japanese patent application Laid-Open No. 39948/1984, values of the intake pressure are stored in a table in relation to the throttle opening and the engine speed, and the intake pressure read from the table is used as the base of computation of the fuel injection rate, after a correction of the intake pressure in consideration of the partial pressures in the exhaust gas in exhaust gas recirculating mode in accordance with a signal derived from a pressure sensor.

It is to be understood that a throttle valve is usually disposed upstream from the pressure sensor and, needless to say, upstream from the combustion chamber of the engine. In consequence, a time lag is inevitably caused because certain periods of time are required for the air-fuel mixture to flow from the position of the throttle valve to the position of the pressure sensor and to the combustion chamber. It is also to be understood that the phase of operation of the throttle valve is ahead of the phase of the change in the actual suction of the mixture by the engine, because of the volume of the space in the intake pipe between the throttle valve and the intake valve of the engine. As a consequence, the phase of the intake pressure P(TA, NE), determined in accordance with the amount of throttle opening and the engine speed, is ahead of the phase of the actual intake pressure P, as shown in FIG. 3. At the same time, as will be seen from FIG. 4, the basic fuel injection rate TP (TA, NE) determined by the throttle opening degree and the engine speed is greater than the actually demanded fuel injection rate because the phase of the change in the amount of throttle opening is ahead of the phase of change in the rate of supply of the mixture to the engine. Therefore, when the fuel injection rate is controlled on the basis of the amount of throttle opening and the engine speed, the actual fuel injection rate exceeds the demanded rate during the acceleration so as to make the mixture excessively rich. Conversely, during the deceleration, the actual fuel injection rate becomes smaller than the demanded rate to make the mixture excessively lean. When an acceleration increment of the fuel supply is conducted, the fuel supply rate is increased as hatched in FIG. 4, and cannot eliminate the undesirable effect caused by the above-described phase advance.

SUMMARY OF THE INVENTION

Accordingly, an object of the present invention is to provide a method of and a system for controlling fuel injection rate in an internal combustion engine, wherein the actual present intake pressure, without any advance or delay of phase, is predicted by detecting the amount of throttle opening which inherently does not have any delay to the change in the intake pressure, thereby enabling the fuel injector to inject the fuel exactly at the rate which is being demanded by the engine, thereby overcoming the abovedescribed problems of the prior art.

To this end, according to a first aspect of the present invention, there is provided a fuel injection rate controlling method having the steps of: computing, in accordance with a present amount of throttle opening and a present engine speed, a present intake, pressure represented by a function of a variable M with an initial value I wherein M is period of time after a change in the amount of throttle opening and I is intake pressure at a time of said change in the amount of throttle opening; computing a basic fuel injection period on the basis of the computed intake pressure and the engine speed; and controlling the fuel injection rate in accordance with the computed basic fuel injection period.

The principle of the first aspect of the invention will be described hereinunder. FIG. 1 schematically shows an intake system of an internal combustion engine. The intake system leads from a throttle valve Th to the intake valve of an engine E through a surge tank S. The control employs parameters such as the pressure P[mmHgabs] of air in the intake system (intake pipe absolute pressure), volume V[l] of the intake system, weight Q[g] of air in the intake system, the absolute temperature T[° K] of the air in the intake system, and the atmospheric air pressure Pc [mmHgabs]. Concepts also are employed such as the weight $\Delta Q_1$ [g/sec] of air introduced into the combustion chamber of the engine E from the intake system per unit time, and the weight $\Delta Q_2$ [g/sec] of air introduced into the intake system through the throttle valve Th. It is also assumed that the weight of the air in the intake system is changed by $(\Delta Q_2-\Delta Q_1)\ \Delta t$ in an infinitesimal time $\Delta t$. It is also assumed that the pressure in the intake passage is changed by $\Delta p$ within the infinitesimal time. The following formula (1) is obtained by applying the Boyle-Charles' Law to the air in the intake system.

$$(P+\Delta P)\,V=\{Q+(\Delta Q_2-Q_1\}RT \tag{1}$$

where, R represents a gas constant.

On the other hand, since the condition of $PV=Q\cdot R\cdot T$ is met, the following formula (2) is obtained through transformation of the formula (1).

$$\frac{\Delta P}{\Delta t}=(\Delta Q_2-\Delta Q_1)\frac{RT}{V} \tag{2}$$

Representing the flow rate coefficient by $\Psi$ and the opening area (amount of throttle opening) by A, the weight $\Delta Q_2$ of air passing through the throttle valve per unit time is given by the following formula (3). Representing the stroke volume by $V_s$, engine speed by NE[rpm] and the suction efficiency by n, the weight $\Delta Q_1$ of air supplied to the engine per unit time is expressed by the following formula (4).

$$\Delta Q_2=\psi\cdot A\sqrt{Pc-P} \tag{3}$$

$$\Delta Q_1=\frac{1}{2}\cdot V_s\cdot\frac{NE}{60}\cdot\eta\cdot P\cdot\frac{1}{RT} \tag{4}$$

The following formula (5) is obtained by substituting the formulae (3) and (4) to formula (2).

$$\frac{\Delta P}{\Delta t}=\frac{RT}{V}\psi A\sqrt{Pc-P}-\frac{1}{2}\ \frac{V_s}{V}\cdot\frac{NE}{60}\cdot\eta\cdot P \tag{5}$$

In the limit condition of $\Delta t\rightarrow 0$, the following formula (6) is obtained.

$$\frac{dP}{dt}=\frac{RT}{V}\psi A\sqrt{Pc-P}-\frac{1}{2}\ \frac{V_s}{V}\cdot\frac{NE}{60}\cdot\eta\cdot P \tag{6}$$

The response characteristic in the region near the pressure $P_0$ ($\neq$Pc) is considered. It is assumed that the pressure has been changed from $P_0$ to $P_0+P$. By substituting $P_0+P$ (P being an infinitesimal) for P in formula (6), the following condition is derived.

$$\frac{dP}{dt}=\frac{RT}{V}\psi A\sqrt{Pc-P_0-P}-\frac{1}{2}\ \frac{V_s}{V}\cdot\frac{NE}{60}\cdot\eta\cdot(P_0+P) \tag{7}$$

Since a condition expressed by the following formula (8) exists, the formula (7) can be transformed into the following formula (9).

$$\begin{aligned}\sqrt{Pc-P_0-P}&=\sqrt{Pc-P_0}\left[1-\frac{P}{Pc-P_0}\right]^{\frac{1}{2}}\\&\approx\sqrt{Pc-P_0}\left[1-\frac{1}{2}\ \frac{P}{Pc-P_0}\right]\\&=\sqrt{Pc-P_0}-\frac{1}{2}\ \frac{P}{\sqrt{Pc-P_0}}\end{aligned} \tag{8}$$

$$\begin{aligned}\frac{dP}{dt}&=\frac{RT}{V}\psi A\sqrt{Pc-P0}-\frac{1}{2}\ \frac{RT}{V}\psi A\frac{P}{\sqrt{Pc-P_0}}-\frac{1}{2}\ \frac{V_s}{V}\cdot\frac{NE}{60}\cdot\eta(P_0+P)\\&=-\frac{1}{2}\left[\frac{V_s}{V}\cdot\frac{NE}{60}\cdot\eta+\frac{RT\psi A}{V\sqrt{Pc-P_0}}\right]P+\frac{RT}{V}\psi A\sqrt{Pc-P_0}-\frac{1}{2}\ \frac{V_s}{V}\cdot\frac{NE}{60}\cdot\eta P_0\end{aligned} \tag{9}$$

On conditions of the following formulae (10) and (11), the formula (9) can be transformed as the following formula (12).

$$a=\frac{1}{2}\left[\frac{V_s}{V}\cdot\frac{NE}{60}\cdot\eta+\frac{RT\psi A}{V\sqrt{Pc-P_0}}\right] \tag{10}$$

$$b=\frac{RT}{V}\psi A\sqrt{Pc-P_0}-\frac{1}{2}\ \frac{Vs}{V}\cdot\frac{NE}{60}\cdot\eta P_0 \tag{11}$$

$$\frac{dP}{dt}=-aP+b \tag{12}$$

The formula (12) is transformed into the following formula (13) and both sides of the formula (13) are integrated with an integration constant C so that the following formula (14) is derived.

$$\frac{dP}{-aP+b} = dt \tag{13}$$

$$-\frac{1}{a}\log(-aP+b) = t + C \tag{14}$$

At the moment t=0, the initial value of the pressure P is expressed by $P_0$ so that the integration constant is determined as follows.

$$C = -\frac{1}{a}\log(-aP_0+b) \tag{15}$$

The pressure P is then derived from the formulae (14) and (15) as follows.

$$P = \frac{b}{a} - \left(\frac{b}{a} - P_0\right)\cdot e^{-at} \tag{16}$$

where, e represents the base of the lognat.

It is therefore possible to determine the actual intake pressure P from the formula (16), by measuring the throttle opening area TA(amount of throttle opening), engine speed NE and the period of time t after a change in the amount of throttle opening, and substituting these values for the formula (16). Then, the basic fuel injection period TP is determined by, for example, the following computation, and the basic fuel injection period TP is corrected in accordance with variable factors such as the intake air temperature and the cooling water temperature. Then, the fuel injector is controlled to open through a time corresponding to this corrected fuel injection period, whereby the fuel is injected at the rate demanded by the engine.

$$TP = K\cdot\sqrt{P}/NE$$

where, K represents a constant.

FIG. 2 graphically shows the intake pressure P as expressed by the formula (16). The pressure P is the output from a first-order time-lag element, which satisfies the condition of P=Po at the moment t=0, and P=b/a (intake pressure in steady state operation of engine) in the condition of $t\rightarrow\infty$ (steady state operation of engine).

The actual intake pressure, therefore, may be determined by computing the intake pressure PMTA during steady state operation of the engine on the basis of the amount of throttle opening TA and the engine speed NE, and processing the intake pressure PMTA during steady state operation of the engine by a first-order delay element expressed by the following transmission function.

$$G(s) = \frac{1}{Ts+1} \tag{17}$$

where, s represents an operator of Laplace transformation, while T represents a time constant.

Thus, according to the first aspect of the invention, the intake pressure during the steady state operation of engine operation is computed on the basis of the amount of throttle opening and the engine speed, and the thus computed intake pressure during the steady state operation of engine operation is processed by a first-order time-lag element, whereby the intake pressure is determined by using the aforementioned time after the change in the amount of throttle opening, as the computing variable.

Thus, in the first aspect of the present invention, the fuel injection rate is controlled in accordance with the engine speed and the intake pressure which is predicted in the manner described above, so that the fuel injection rate can be controlled in such a manner as to correspond to the actual intake air flow rate, whereby the air-fuel ratio of the mixture is correctly controlled at the command level so as to prevent the air-fuel ratio from becoming too rich or too lean.

According to a second aspect of the present invention, there is provided a fuel injection rate control system of an internal combustion engine, comprising: throttle opening amount detecting means for detecting the amount of throttle opening; engine speed detecting means for detecting the engine speed; intake pressure computing means for computing, at a predetermined frequency (period), the intake pressure during steady state operation of the engine in accordance with the detected amount of throttle opening and the detected engine speed; intake pressure correction means for effecting correction of the computed intake pressure during the steady state operation by employing a response delay of the intake pressure in the transient period; basic fuel injection period computing means for computing a basic fuel injection rate on the basis of the corrected intake pressure corrected by the correction means and the detected engine speed; and fuel injection rate control means for controlling the fuel injection rate at least on the basis of the basic fuel injection period.

The basic operation of this second aspect of the present invention will be described with reference to a block diagram shown in FIG. 6. First of all, the intake pressure PMTA during the steady state operation of the engine is computed by the intake pressure computing means A, on the basis of the amount of throttle opening TA detected by the throttle opening amount detecting means and the engine speed NE detected by the engine speed detecting means. The intake pressure PMTA during the steady state operation of the engine computed by the intake pressure computing means A is processed by the correction means B to eliminate any factor attributable to the delay of the intake pressure in the transient period of the engine operation. The correction means may be constituted by a first-order time-lag element. The intake pressure, after the correction is performed by the correcting means B, is input to the basic fuel injection period computing means C which computes, from the corrected intake pressure and the engine speed NE which also is received by the computing means C, the basic fuel injection period TP. Then, the fuel injection rate control means controls the fuel injection rate in accordance with the thus determined basic fuel injection period.

According to the second aspect of the invention, the actual intake pressure can be precisely predicted with a simple arrangement, because it is devoid of any delaying element such as a pressure sensor and a filter, whereby the fuel injector can inject the fuel precisely at the rate demanded by the engine.

According to a specific form of the present invention, there is provided a method of controlling fuel injection rate in an internal combustion engine comprising: computing, at a predetermined period (frequency), an intake pressure during steady state operation of the engine in accordance with the amount of throttle opening and the engine speed; computing a coefficient of weight that is weighing coefficient from a time constant concerning a change in the intake pressure in a transient period and also from the predetermined period; computing the present weighted mean value of the present intake pressure from the previously computed weighted mean value of intake pressure, intake pressure computed in the steady state operation of the engine and the coefficient of to weight, setting a greater value for the previously computed weighted means of intake pressure; computing the basic fuel injection period from the present weighted mean value of the intake pressure computed in the preceding step and the engine speed; and controlling the fuel injection rate in accordance with the computed basic fuel injection period.

The principle of this specific form will be described hereinunder. FIG. 5 illustrates a first-order time-lag element. The relationship between the input x(t) and the output y(t) of this element is expressed by the following formulae, representing the time constant by T.

$$\frac{1}{T}\int_0^t e^t\,dt = y(t) \tag{18}$$

$$\frac{1}{T}\int_0^t \{x(t) - y(t)\}\,dt = y(t) \tag{19}$$

$$\frac{1}{T}\int_{t_1}^{t_2} \{x(t) - y(t)\}\,dt + \frac{1}{T}\int_0^{t_1} \{x(t) - y(t)\}\,dt = y(t) \tag{20}$$

The following formula (21) is obtained by representing the present computing timing $t_2$ and the previous computing timing by $t_1$.

$$\frac{1}{T}(t_2 - t_1)\cdot\{x(t_2) - y(t_1)\} + y(t_1) = y(t_2) \tag{21}$$

In formula (21) above, $x(t_2)$ corresponds to the intake pressure PMTA in the steady state operation, $y(t_2)$ represents the present actual intake pressure $PMSM_i$, $y(t_1)$ represents the actual previous intake pressure $PMSM_{i-t}$, and $t_{2-t1}$ represents the period of computation. Thus, the formula (21) can be rewritten as follows.

$$\frac{\Delta t}{T}(PMTA - PMSM_{i-1}) = PMSM_{i-1} = PMSM_i \tag{22}$$

The formula (22) is further modified as follows, representing $T/\Delta t$ by n.

$$PMSM_i = \frac{(n-1)\cdot PMSM_{i-1} + PMTA}{n} \tag{23}$$

The formula (23) suggests that the present actual intake pressure $PMSM_i$ can be determined through computing a weighted mean value by giving a weight (n-1) to the actual previous intake pressure $PMSM_{i-1}$ and giving a weight of 1 to the intake pressure PMTA in the steady state (operation) of the engine. The coefficient n of the weight is determined as the ratio between the time constant T and the period $\Delta t$ of the computation.

Thus, according to this form of the present invention, the actual present intake pressure can be determined by: computing, at a predetermined period $\Delta T$, an intake pressure PMTA during a steady state of the engine in accordance with the amount of throttle opening and the engine speed; computing a coefficient n of to weight from a time constant T concerning a change in the intake pressure in a transient period and also from the predetermined period $\Delta T$; and computing the present weighted mean value $PMSM_{i-1}$ of the present intake pressure from the previously computed weighted mean value $PMSM_{i-1}$ of intake pressure, intake pressure PMTA computed in the steady state operation and the coefficient n of to weight, setting a greater value for the previously computed weighted mean value $PMSM_{i-1}$ of intake pressure. In this form of the present invention, the fuel injection rate is controlled on the basis of a basic fuel injection rate which is determined in accordance with the weighted mean value (actual present intake pressure) determined as above and the engine speed.

As will be understood from the formulae (10) and (16), the time constant $T=1/a$ becomes small as the engine speed NE is increased, and also as the amount of throttle opening is increased. Thus, the time constant is expressed as a function of the amount of throttle opening TA and the engine speed NE. Assuming that the computing period $\Delta T$ is constant, therefore, the coefficient n of relating to the weight can be determined as a function of the amount of throttle opening TA and the engine speed. Since the intake pressure PMTA during the steady state operation of engine can definitely be determined by the amount of throttle opening TA and the engine speed NE, the coefficient n of to the weight may be determined in accordance with the combination of the intake pressure PMTA in the steady state operation of the engine and the engine speed NE, instead of the combination of the amount throttle opening TA and the engine speed NE.

The actual amount of supply of the air to the combustion chamber is definitely determined only after the intake stroke is finished, i.e., only after the intake valve is closed. As a matter of fact, however, the computation of the desired fuel injection rate after the closing of the intake valve obviously involves a delay to the actual engine operation, because a certain period is required for the arithmetic operation itself, as well as for the injected fuel to reach the combustion chamber. For this reason, it has been a common practice to compute the basic fuel injection period on the basis of the amount of intake pressure before the amount of air supplied to the combustion chamber is definitely determined. According to such a practice, the fuel injection rate often fails to match the actual rate of supply of the air to the engine. More specifically, during acceleration of the engine, the fuel injection rate is controlled on the basis of the intake pressure which is lower than the intake pressure determined by the intake air flow rate, so that the air-fuel mixture becomes too lean. Conversely, during deceleration, the fuel injection rate is controlled on the basis of the intake pressure which is higher than the intake pressure determined by the intake air flow rate, so that the air-fuel mixture becomes too rich.

Assume here that the amount of throttle opening TA and the engine speed NE are fixed in the formula (23) above. In such a case, the intake pressure PMTA is maintained constant throughout the period from the moment of computation of the weighted mean value until the moment of determination of the intake air flow rate, i.e., for a predetermined period from the computation of the weighted mean value. It is therefore possible to predict the actual intake pressure to be attained at the time of determination of the intake air flow rate by repeatedly conducting the weighted mean value of formula (23).

Therefore, in this specific form of the invention, the fuel injection rate is preferably controlled by predicting the actual intake pressure which is to be attained at the moment when the amount of air supplied to the engine is definitely determined, i.e., the weighted mean value obtained at the moment at which the amount of air supplied to the engine is scheduled to be definitely determined. This can be conducted by determining the number of computing cycles required, which is determined through dividing, by the computing period $\Delta t$, the period from the moment at which the intake pressure is computed until the moment (time) at which the amount of air supplied to the engine is definitely settled. The computation of formula (23) is conducted repeatedly by a number equal to the above-mentioned number of computing cycles.

The foregoing description of principle is based upon an assumption that the amount of throttle opening and the engine t speed are maintained constant throughout the period between the moment at which the fuel injection rate is computed and the moment at which the amount of air supplied to the engine is definitely determined.

When the amount of throttle opening and/or the engine speed is changed, the actual intake pressure can be predicted with a higher degree of precision, by predicting the amount of throttle opening and/or the engine speed which is expected to be attained at the moment of the next fuel injection rate computation, by making use of the differential of the amount of throttle opening and/or of the engine speed at the time of the first fuel injection rate computation, predicting the intake pressure during steady state operation which is to be attained when the amount of intake air supplied to the engine is definitely settled, and then repeatedly conducting the computation of the weighted mean value so as to predict the actual intake pressure.

As is well known, in internal combustion engines of the fuel injection-type, a considerable part of the injected fuel inevitably attaches to the surface of the wall of the intake system, e.g., the wall of an intake manifold. Thus, not all of the injected fuel can directly reach the engine. The control of the fuel injection rate, therefore, is preferably conducted taking into account the amount of fuel attaching to the wall of the intake system.

In general, the amount of fuel attaching to the wall of the intake system has a certain dependency on the intake pressure. Namely, the amount of fuel attaching to the wall is decreased as the intake pressure is reduced because evaporation is promoted, and is increased as the intake pressure rises because evaporation is suppressed.

In this form of the invention, therefore, the amount of change in the quantity of fuel attaching to the wall is predicted from the actual intake pressure computed by the weighted mean value, and the fuel injection rate is controlled to match for the actual intake air flow rate taking into account also the variance in the quantity of fuel attaching to the wall. The quantity of fuel attaching to the wall varies also in accordance with the engine temperature or the engine speed. The quantity of the fuel attaching to the wall of the intake system also has dependency on other factors such as the engine temperature and the speed of the engine. Namely, a higher engine temperature promotes the evaporation so that the attaching fuel quantity is decreased. The quantity of the fuel attaching to the wall also decreases as the engine speed is increased, because evaporation is promoted by the higher velocity of intake air flowing through the intake system. The change in the quantity of the fuel attaching to the wall therefore may be defined as a function of the engine temperature or the engine speed. The quantity of the fuel attaching to the wall cannot be settled in real time. The arrangement, therefore, may be such that the amount of correction of the fuel injection rate be time-attenuated such that the quantity of fuel presently injected and made to attach is used as a factor for the control of the fuel injection rate in the next fuel injection.

As has been described, according to this form of the invention, the actual intake pressure is predicted through the computation of the weighted mean value at the predetermined period, so that the actual intake pressure can be predicted without measuring the time from the change in the amount of throttle opening. This makes it possible to properly control the air-fuel ratio to the command value, thus eliminating various inconveniences such as poor driveability and increased noxious exhaust emissions.

These and other objects, features and advantages of the present invention will become clear from the following description of the preferred embodiments when the same is read in conjunction with the accompanying drawings.

DESCRIPTION OF THE PREFERRED EMBODIMENTS

Figure 1:
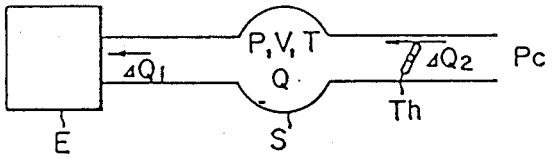
FIG. 1 is a diagram explanatory of the principle of the first aspect of the present invention.
Figure 2:
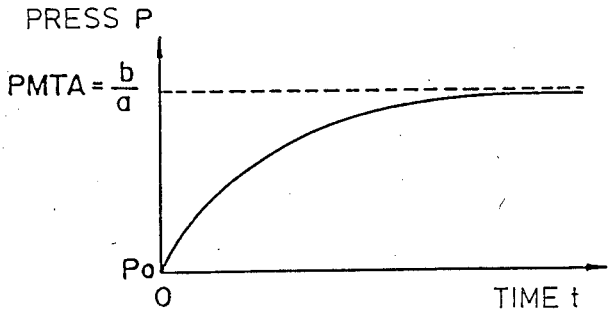
FIG. 2 is a diagram illustrating the manner in which actual intake pressure varies in relation to time.
Figure 3:
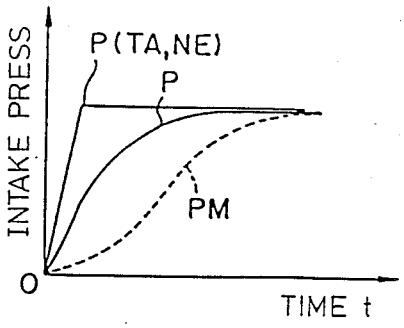
FIG. 3 is a diagram illustrating the difference between the actual intake pressure and the intake pressure determined by the conventional method from the amount of throttle opening and the engine speed.
Figure 4:
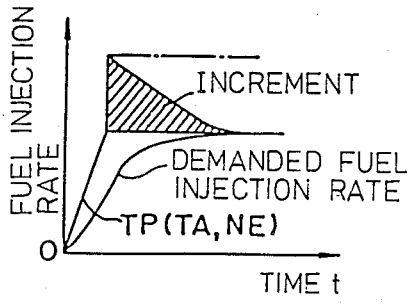
FIG. 4 is a diagram illustrating a difference between the fuel injection rate actually demanded by an engine and the fuel injection rate determined by the conventional method from the amount of throttle opening and the engine speed.
Figure 5:
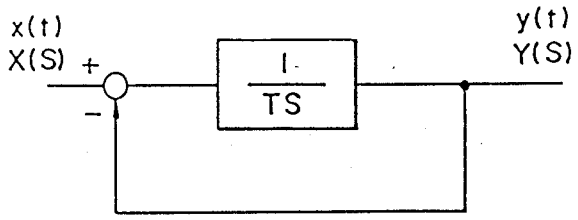
FIG. 5 is a block diagram illustrating the principle of a specific form of the present invention.
Figure 6:
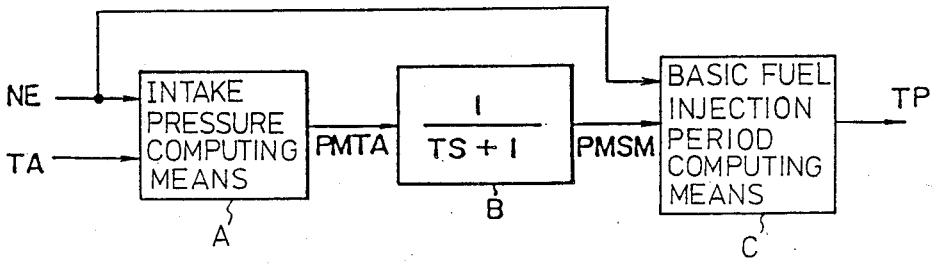
FIG. 6 is a block diagram explanatory of a second aspect of the present invention.
Figure 7:
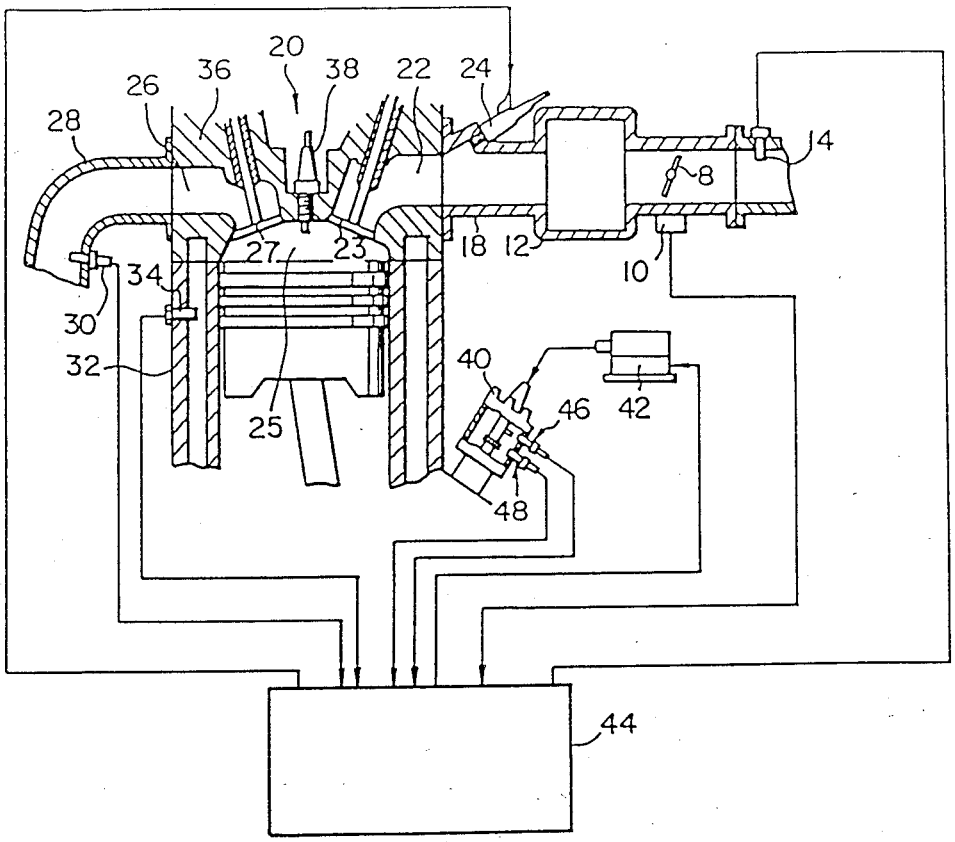
FIG. 7 is a schematic illustration of an internal combustion engine equipped with a fuel injection system embodying the present invention.

Preferred embodiments of the present invention will be described hereinunder with reference to the accompanying FIG. 7 schematically shows an internal combustion engine which is equipped with a fuel injection rate control system in accordance with the present invention.

Figure 8:
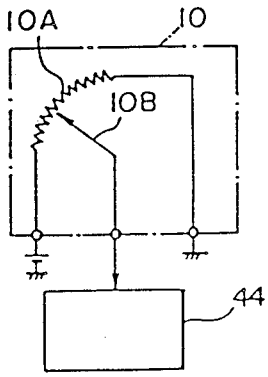
FIG. 8 is diagram showing an equivalent circuit of a throttle opening sensor.

The engine has an intake system which is provided with an air cleaner (not shown) and a throttle valve 8 disposed downstream from the air cleaner. A throttle opening sensor 10 attached to the throttle valve 8 is capable of detecting the amount of opening of the throttle valve 8. As will be seen from an equivalent circuit diagram shown in FIG. 8, the throttle opening sensor 10 has a contactor 10B fixed to the shaft of the throttle valve 8 and a variable resistor 10B which is connected at its one end to a power supply and grounded at its other end. The condition of contact between the contactor 10B and the variable resistor 10A is changed in accordance with a change in the opening amount of the throttle valve 8, whereby a voltage corresponding to the opening amount of the throttle valve 8 is obtained at the contactor 10B. A temperature sensor 14 constituted by a thermistor is attached to the wall of the intake pipe upstream of the throttle valve 8. This temperature sensor 14 is capable of sensing the temperature of the intake air. A surge tank 12 provided downstream of the throttle valve 8 is communicated with the combustion chamber 25 in the engine 20 through an intake manifold 18, an intake port 22 and an intake valve 23. The intake manifold 18 has branch pipes connected to the respective cylinders of the engine and provided with fuel injectors 24. The fuel injectors 24 are adapted to inject fuel independently or alternatively, the fuel injectors are grouped into a plurality of groups such that fuel injectors of a group can inject simultaneously, or all the fuel injectors inject at once.

The combustion chamber 25 is communicated with a catalyst device (not shown) charged with a ternary catalyst, through an exhaust valve 27, exhaust port 26 and an exhaust manifold 28. The exhaust manifold is provided with an $0_2$ sensor 30 which is capable of sensing the concentration of residual oxygen concentration in the exhaust gas and adapted for producing a signal which is inverted across a threshold level corresponding to the stoichiometric air-fuel ratio.

The cylinder block 32 has a cooling water temperature sensor 34 constituted by, for example, a thermistor, projecting into a water jacket and capable of detecting the cooling water temperature as a representative of the engine temperature. The cylinder block 36 is equipped with spark plugs 38 which project into respective combustion chambers 25. The spark plug 38 is connected to a control circuit 44 constituted by, for example, a microcomputer, through a distributor 40 and an igniter 42 having a sparking coil. The distributor 40 has a signal rotor fixed to the distributor shaft and pick-ups fixed to the distributor housing, which in combination constitute a cylinder discriminating sensor 46 and a rotary angle sensor 48. The cylinder discriminating sensor 46 is adapted to produce a cylinder discriminating signal for each 720° of the crank angle CA, whereas the rotary angle sensor 48 produces a rotation angle signal for each 30° of the crank angle CA. The engine speed can be computed from the period of the rotation angle signal.

Figure 9:
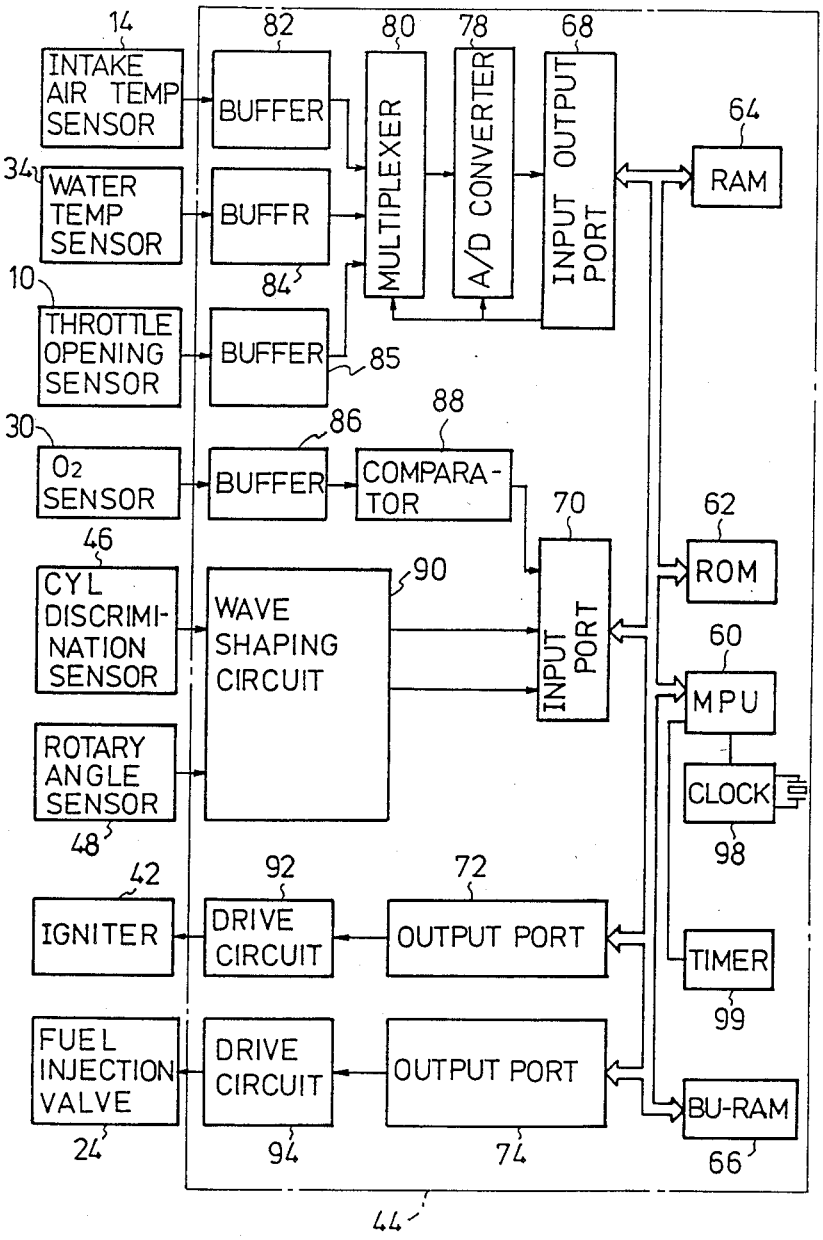
FIG. 9 is a block diagram showing the detail of the control circuit shown in FIG. 8.

The control circuit 44 which is constituted by the microcomputer has, as shown in FIG. 9, a microprocessing unit (MPU) 60, a read only memory (ROM) 62, a random access memory (RAM) 64, a backup RAM (BU-RAM) 66, an input/output port 68, an input port 70, output ports 72, 74 and BUSes 75 such as data BUS and control BUS interconnecting these elements. An analog-to-digital (A/D) converter 78 and a multiplexer 80 are sequentially connected to the input/output port 68. An intake temperature sensor 14 is connected through the buffer 82 to the multiplexer 80. In addition, the water temperature sensor 34 and the throttle opening sensor 10 are respectively connected to the multiplexer 80 through buffers 84 and 85, respectively. The input/output port 68 is connected to the A/D converter 78 and the multiplexer 80 so that the outputs from the intake air temperature sensor 14, water-temperature sensor 34 and the throttle opening sensor 10 are sequentially output to the A/D converter in accordance with the control signals from the MPU.

A comparator 88 is connected to the input port 70. The $0_2$ sensor 30 also is connected to the input port 70 through a buffer 86. The cylinder discrimination sensor 46 and the rotary angle sensor 48 are also connected to the input port 70 through a wave shaping circuit 90. The output port 72 is connected through a driving circuit 92 to the igniter 42, while an output port 74 is connected to the combustion chamber 24 through the driving circuit 94.

Figure 10:
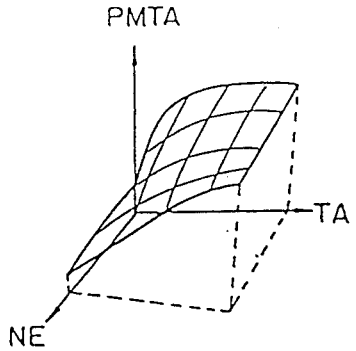
FIG. 10 is a table containing data concerning the intake pressure in a steady condition of engine operation.
Figure 11:
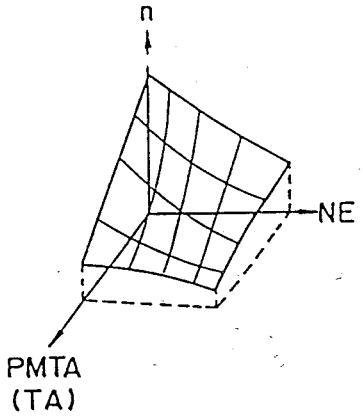
FIG. 11 is a diagram illustrating a table containing data of a coefficient of to weighting used in the computation of a weighted mean value.
Figure 12:
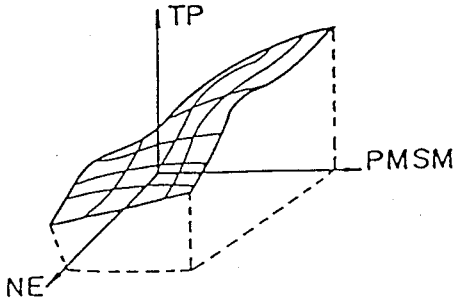
FIG. 12 is a table containing data concerning basic fuel injection period.
Figure 13:
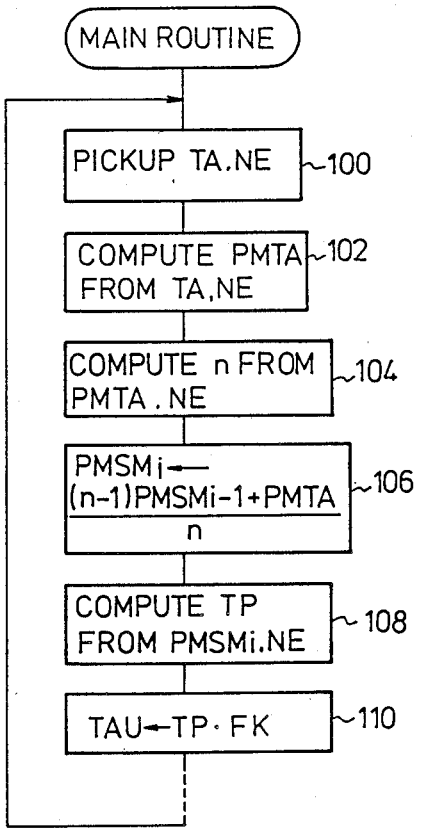
FIG. 13 is a flow chart showing the fuel injection rate computing routine of the first embodiment.

A description will be made hereinunder as to the first embodiment of the present invention applied to the internal combustion engine which has the construction described hereinbefore. The ROM 62 beforehand stores the following data: a program of the control routine of the first embodiment described hereinunder; a table of FIG. 10 storing values of intake pressure PMTA during a steady state operation of the engine with parameters of the amount of throttle opening TA and the engine speed NE; a table of FIG. 11 storing values of the coefficient n of to weight with parameters of the engine speed NE and the intake pressure PMTA during the steady state operation of the engine (or the amount of throttle opening TA); and a table storing values of the basic fuel injection period TP with parameters of the engine speed NE and the actual intake pressure PMSM. The table shown in FIG. 10 storing the values of the intake pressure PMTA in the steady state operation of the engine can be formed by setting the amount of throttle opening TA and the engine speed NE, measuring the intake pressure corresponding to the amount of throttle opening TA and the engine speed NE, and using the value of the intake pressure after it is settled. The table shown in FIG. 11 showing the values of coefficient n relating to the weight, measuring the time constant T of the response (indicial response) of the intake pressure to a stepped increase in the opening amount of the throttle valve, and determining the value of $T/\Delta T$ ($\approx n$) from the period $\Delta T$ sec of execution of the computing routine shown in FIG. 13, in relation to the engine speed NE and the intake pressure PMTA (or amount of throttle opening TA). The table shown in FIG. 12 containing the values of the basic fuel injection period TP can be obtained by setting the engine speed and the intake pressure and measuring the basic fuel injection period TP which provides a command air-fuel ratio corresponding to the set values of the engine speed and the intake pressure.

A description will be made hereinunder as to the routine for computing the fuel injection period. This routine is executed at a predetermined period of, for example, 8 msec. In Step 100, the microprocessing unit picks up the A/D converted amount of throttle opening TA (A/D converted at period of 8 msec, for example), as well as the engine speed NE. In Step 102, the intake pressure PMTA in the steady state operation of engine is computed in accordance with the amount of throttle opening TA and the engine speed NE in accordance with Table shown in FIG. 10. In Step 104, the coefficient n of to the weight is computed in accordance with the content of the table shown in FIG. 11, from the values of the intake pressure PMTA computed in Step 102 and the engine speed NE picked up in Step 100. When the table of the coefficient n of to the weight has been determined in relation to the amount of throttle opening and the engine speed, the flow may be modified such that the coefficient n of to the weight is computed in Step 104 on the basis of the amount of throttle opening TA and the engine speed NE. In step 106, a computation is executed in accordance with the formula (23) by employing the intake pressure PMTA computed in Step 102, the coefficient n of to the weight computed in Step 102 and the previously weighted mean value $PMSM_{i-1}$ computed in this Step 106 in the preceding computing cycle, thereby determining the present weighted mean value $PMSM_i$. In Step 108, the basic fuel injection period TP is computed from the table shown in FIG. 12, in accordance with the present weighted mean value $PMSM_i$ and the engine speed NE. In Step 110, the basic fuel injection period TP is multiplied with a correction coefficient FK which is determined in accordance with factors such as the intake air temperature and the engine cooling water temperature, whereby a corrected fuel injection period TAU is obtained. When a predetermined crank angle has been reached in a control routine which is not shown, the fuel injector is opened for a period corresponding to the fuel injection period TAU, thereby executing the fuel injection.

Figure 14:
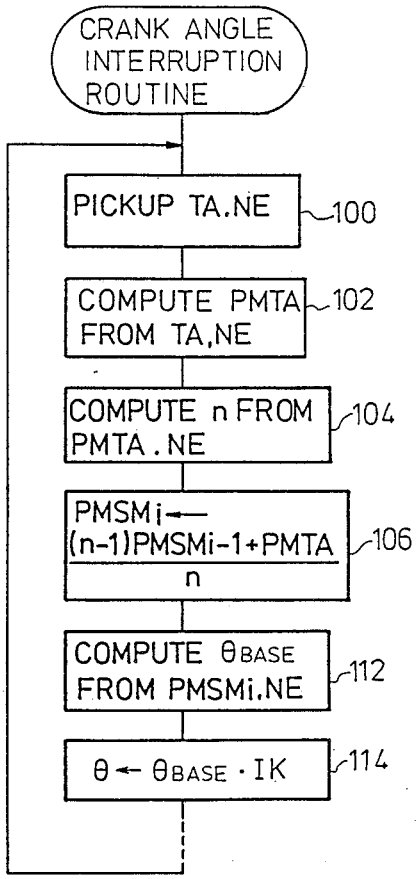
FIG. 14 is a flow chart of an ignition advance angle computing routine in the above-mentioned embodiment.

FIG. 14 shows a routine for computing the ignition advance angle $\theta$ by interruption for each crank angle. In FIG. 14, the same reference numerals are used to denote the same parts as those shown in FIG. 13, and detailed description of such parts is omitted. In Step 112, the basic ignition advance angle $\theta_{BASE}$ is computed in accordance with the presently computed weighted mean value $PMSM_i$ and the engine speed NE. The basic ignition advance angle $\theta_{BASE}$ may be computed in accordance with a suitable formula or may be stored in a table so as to be read from the table, as in the case of the basic fuel injection period. In Step 114, the basic ignition advance angle $\theta_{BASE}$ is multiplied by a correction factor IK which is determined by the intake air temperature and the engine cooling water temperature, and a corrected ignition advance angle $\theta$ is obtained. Then, ignition is executed by turning off the igniter at the timing corresponding to the basic ignition angle 0 by an ignition timing control routine which is not shown.

Figure 15:
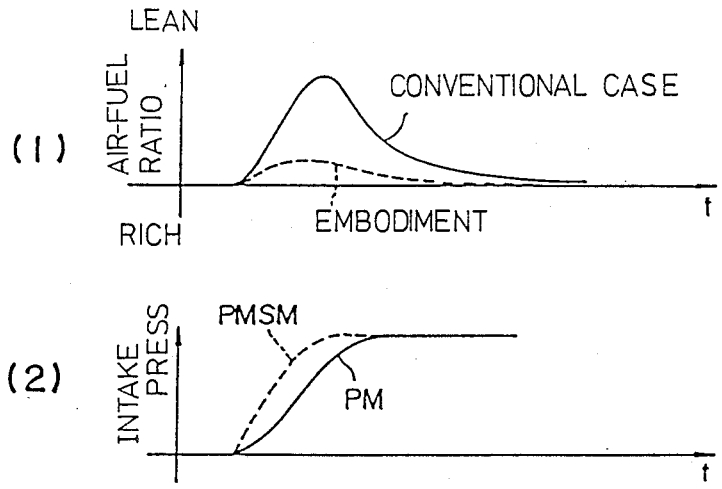
FIGS. 15(1) and 15(2) are diagrams illustrating a change in the intake pressure in a conventional system and a change in the intake pressure in the embodiment of the present invention.

FIGS. 15(1) and 15(2) show the manner in which the air-fuel ratio of the mixture is changed during acceleration under the control in accordance with the invention, in comparison with the manner in which the air-fuel ratio is changed by the conventional control, as well as the difference between the weighted mean value PMSM used in the described embodiment and the detected intake pressure PM used in the conventional control. As will be understood from FIG. 15, the air-fuel ratio under the conventional control exhibits a lean spike, whereas the air-fuel ratio obtained under the control of the described embodiment is substantially flat.

As will be understood from the foregoing description, in the described embodiment of the present invention, the fuel injection rate and the ignition timing are controlled with high degrees of precision without employing any pressure sensor and filter, by predicting the actual intake pressure and controlling the fuel injection rate and the ignition timing in accordance with the predicted actual intake pressure.

Figure 16:
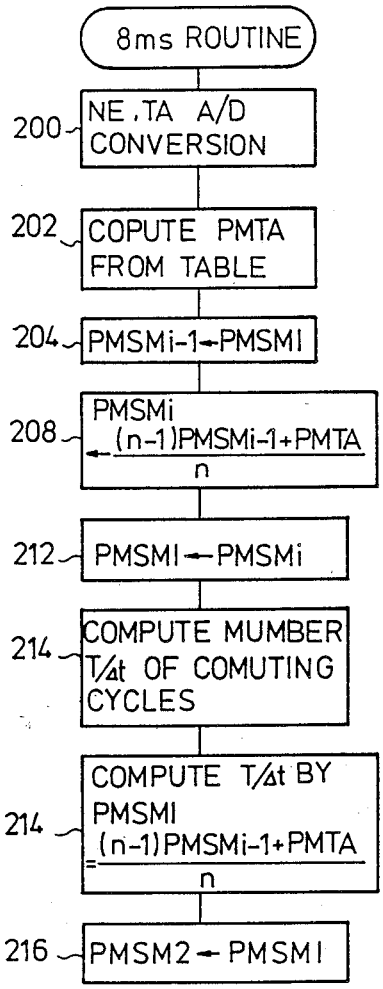
FIG. 16 is a flow chart of a routine for computing the predicted value of the intake pressure in a second embodiment of the invention.

A description will be made hereinunder as to a second embodiment of the present invention which is applied to the same engine as the first embodiment. The second embodiment is characterized in that the arithmetic operation for determining the weighted mean value is conducted repeatedly for a predetermined time, so as to predict the actual intake pressure which is to be attained at the time of definite determination of the amount of supply of the intake air, i.e., the intake pressure which has been reached when the intake valve is fully closed, and the fuel injection rate is controlled in accordance with the thus predicted intake pressure. FIG. 16 shows a routine which is executed cyclically for a predetermined period (8 msec in this embodiment) so as to compute the predicted value PMSM2 of the intake pressure which is to be attained at the time of definite determination of the intake air amount. In Step 200, the microprocessor 200 picks up the engine speed NE, and conducts the A/D conversion of the amount of throttle opening TA, thereby obtaining the amount of throttle opening TA. In Step 202, the intake pressure PMTA in the steady state operation of engine corresponding to the engine speed NE and the amount of throttle opening TA is computed from the table shown in FIG. 10. Subsequently, in Step 204, the coefficient n of to the weight is computed from the table shown in FIG. 11. Then, in Steps 206 and 208, the previously computed weighted mean value $PMSM_{i-1}$ stored in the register $PMSM_1$ is read from the RAM, and the computation is conducted in accordance with the formula (23) so as to determine the present weighted mean value $PMSM_i$. The thus computed weighted mean value $PMSM_i$ is stored in the register PMSM1 in Step 210. In Step 212, the time T msec from the instant moment until the moment at which the intake pressure is predicted is divided by the computing period $\Delta t$(=8msec), thus determining the number $T/\Delta t$ of the computing cycles. The prediction time T msec maybe the time from the present moment until the definite determination of the intake air amount supplied to the engine, i.e., until the intake valve is closed. If the engine does not have fuel injectors for independent cylinders, the prediction time T msec is determined taking into account also the fuel injector to the respective combustion chambers, i.e., the time over which the fuel is required to fly until it reaches the cylinders. The prediction time T msec becomes short as the engine speed is increased, even when the length between the present moment until the moment at which the aimed state is obtained is constant in terms of the crank angle. It is therefore preferred that the prediction time is varied in accordance with conditions such as the engine speed. For instance, the prediction time is set to be short in accordance with a rise in the engine speed.

In Step 214, the computation of formula (23) is executed repeatedly for $T/\Delta t$ times, and the thus computed value is set as the predicted value PMSM2 of the intake pressure in Step 216. By repeating the computation of the weighted mean value as described, the most current value of the computed weighted mean value approaches the intake pressure during a steady state operation of engine. Therefore, by selecting the number of cycles of the arithmetic operation for computing the weighted mean value in the described manner, it is possible to predict the intake pressure at a future moment which is T msec after the present moment, i.e., the intake pressure in a state which is closer to the steady state than the present state is.

Figure 17:
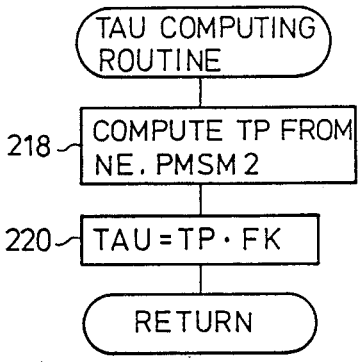
FIG. 17 is a flow chart illustrating the routine for computing the fuel injection period in the second embodiment of the present invention.

FIG. 17 shows a routine for computing the fuel injection period TAU for each predetermined crank angle, e.g., 120°. In this routine, the basic fuel injection period TP is determined from the table shown in FIG. 12, on the basis of the engine speed NE and the predicted value PMSM2 of the intake pressure computed in Step 216. Then, in Step 220, the fuel injection period TAU is computed in the same manner as Step 110 in the first embodiment.

Figure 18:
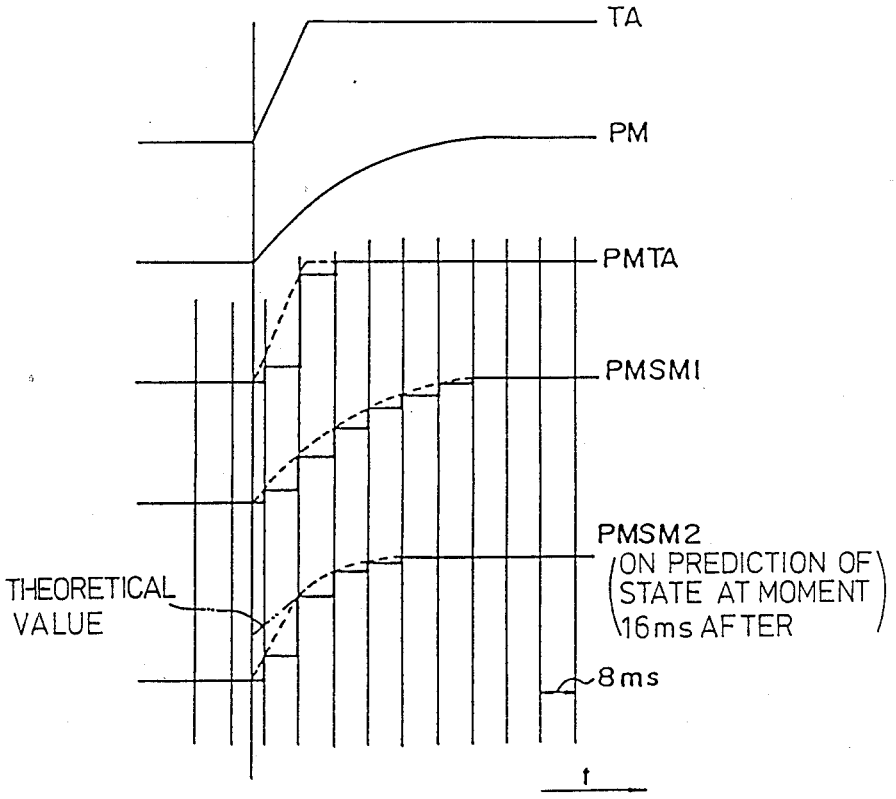
FIGS. 18 and 19 are diagrams illustrating the pattern of change in the predicted value of the intake pressure in the second embodiment.
Figure 19:
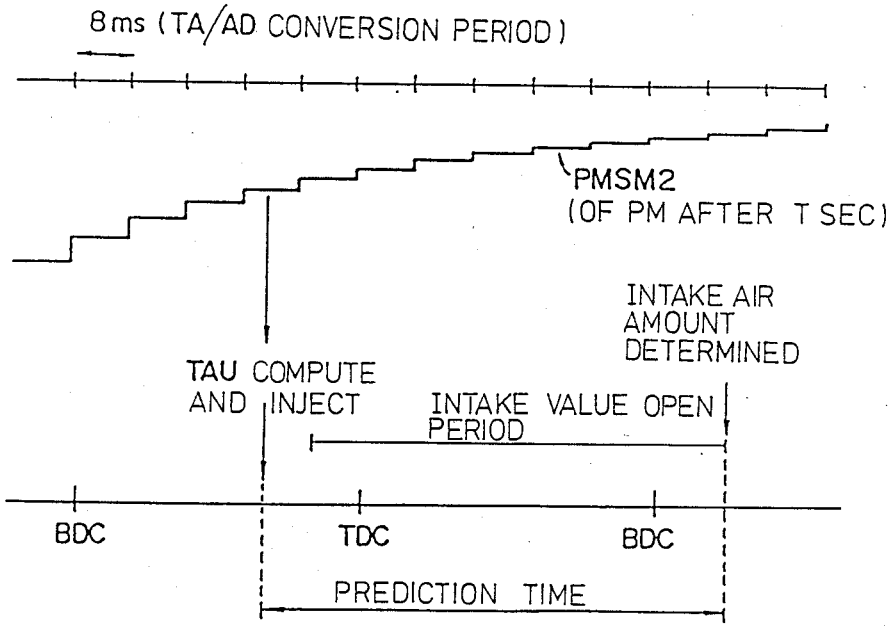

The amount of throttle opening and/or the engine speed may change at a future moment which is T msec after the present moment. Therefore, it is useful to predict the amount of throttle opening and/or the engine speed at the future moment which is T msec after the present moment, by making use of the differentials of the amount of throttle opening and/or the engine speed, and to repeat the computation of the weighted mean value by employing these differentials, so that the precision of the control is further improved. The weighted mean value computed in the described manner and the predicted value PMSM2 which is expected to be attained at the moment T msec after the present moment are shown in FIGS. 18 and 19. FIG. 18 illustrates the predicted value and a theoretical value which are to be obtained at a future moment 16 msec after the present moment. It will be seen that the predicted value is substantially the same as the theoretical value. The timing of A/D conversion of the throttle opening sometimes coincides with the timing of computation of the fuel injection period but may be offset from the timing of computation of the fuel injection rate. The amount of offset is $\Delta T$ at the greatest. The average offset time, therefore, can be expressed as $(0 + \Delta T)/2$. The described second embodiment, therefore, may be carried out by predicting the intake pressure which is to be attained at a moment expressed by $T \pm \Delta T/2$.

Figure 22:
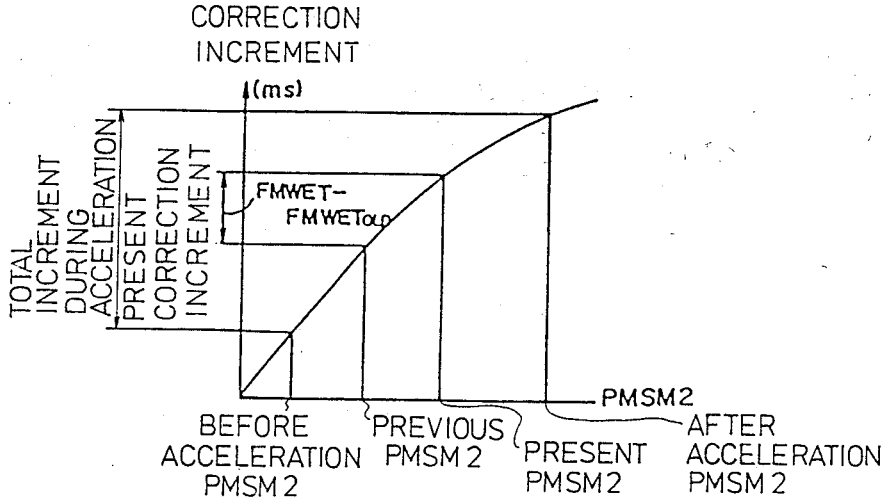
FIGS. 22 and 23 are diagrams illustrating the table containing data concerning the amount of correction of the fuel injection rate.

A third embodiment of the invention will be described hereinunder. The third embodiment features a correction of fuel injection rate on the basis of the predicted quantity of fuel attaching to the wall of the intake system of the engine. The quantity of the fuel attaching to and remaining on the wall of the intake system without being fed to the engine is determined by the intake pressure established in the intake pipe when the intake valve of the engine is opened. It is assumed here that the intake pressure has been changed from PM1 to PM2 as a result of acceleration of the engine, and also that the thicknesses of the film of the fuel in liquid state attaching to the intake system wall are T1 and T2, respectively. The amount of fuel which is to be supplied to the wall surface so as to increase the film thickness from T1 to T2 is determined regardless of factors such as throttle opening speed and the number of the fuel injection cycles. In this embodiment, therefore, the total quantity of the fuel to be supplied to the wall surface, which is required when the intake pressure is increased to various levels from a certain reference intake pressure, is stored in the from of a table in a ROM as shown in FIG. 22.

Figure 20:
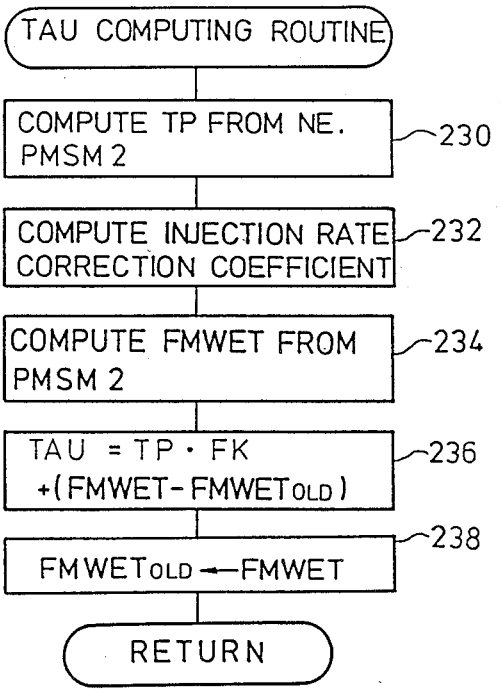
FIG. 20 is a flow chart illustrating a routine for computing the fuel injection period in the present invention.

FIG. 20 shows a fuel injection rate computing routine which is executed in this embodiment for each predetermined crank angle (360° in the illustrated case). In Step 230, a basic fuel injection period TP is computed in the same manner as the preceding embodiments from the predicted value PMSM2 of the intake pressure computed in the routine shown in FIG. 16. Step 232 is a step for computing a correction factor FK of the fuel injection rate determined by factors such as the intake air temperature and the cooling water temperature. In Step 234, a computation is executed in accordance with the table of FIG. 22 so as to compute the quantity FMWET of fuel attaching to the wall of the intake system corresponding to the predicted intake pressure PMSM2. In a subsequent Step 236, the basic fuel injection period is multiplied with the correction factor FK and, at the same time, a fuel injection period TAU is determined by adding a correction value to the result of the multiplication. This correction value is a value which represents the amount of change in the quantity of the fuel attaching to the intake system wall, and is obtained by subtracting a previously determined quantity $FMWET_{OLD}$ of fuel attaching to the intake system wall from the presently determined quantity FMWET of fuel attaching to the intake system wall. In Step 238, the presently determined quantity FMWET of fuel attaching to the intake system wall is stored in the RAM so as to be used as the previously determined quantity $FMWET_{OLD}$ of fuel attaching to the intake system in the next cycle of computation.

Figure 21:
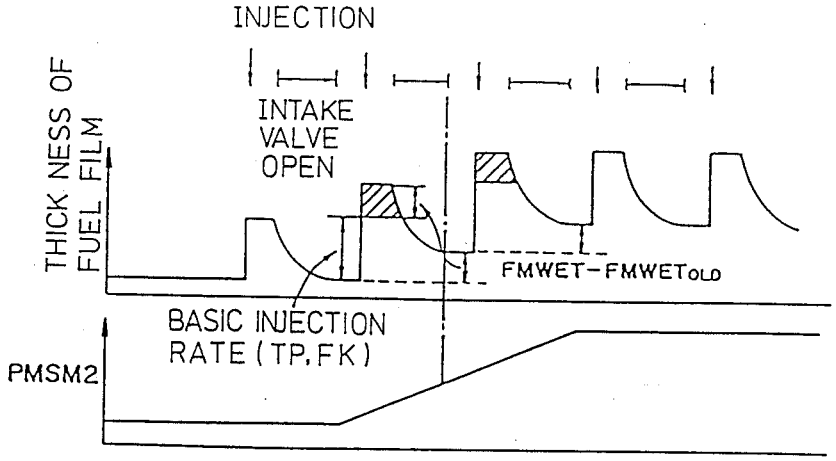
FIG. 21 is a diagram illustrating the thickness of the fuel film attaching to the wall in relation to the intake pressure.
Figure 24:
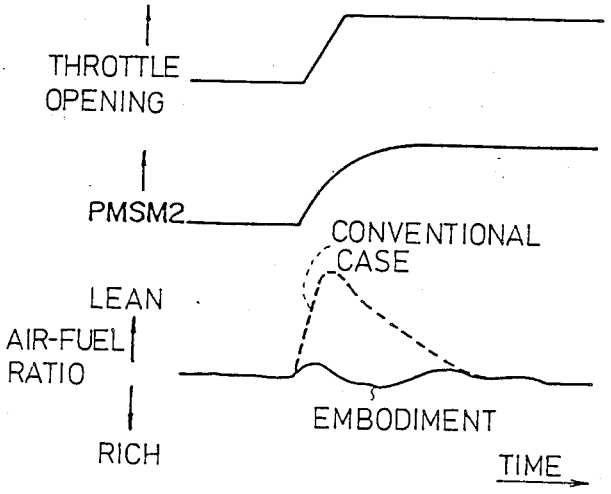
FIG. 24 is a diagram illustrating a pattern of change in the air-fuel ratio in accordance with a third embodiment in comparison with that of a conventional system.

As a result of the described control of the fuel injection rate, the fuel injection rate is increased by an amount corresponding to the hatched area in FIG. 21. This increment of the fuel injection rate is compensated for by the increase in the quantity of fuel attaching to the intake system wall, so that the engine can be supplied with the fuel at the very rate which it demands, by virtue of the incremental correction of the injection rate. FIG. 24 illustrates the manner in which the amount of throttle opening, predicted intake pressure and the air-fuel ratio are changed. In this embodiment, the fluctuation of the air-fuel ratio is suppressed as compared with the conventional case shown by broken lines and including lean spikes.

Figure 25:
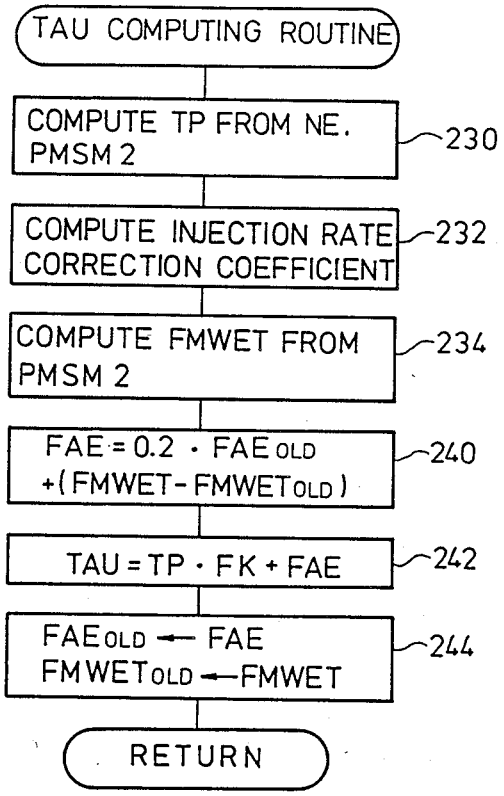
FIG. 25 is a flow chart illustrating the routine for computing the fuel injection rate in the third embodiment.

A fourth embodiment of the invention will be described hereinunder. In the third embodiment, the correction for compensating for the change in the quantity of fuel attaching to the intake system wall is conducted in every fuel injection cycle. In contrast, the fourth embodiment described hereinbelow employs a time-attenuation of the incremental correction in every injection cycle, in consideration of the fact that the attaching of fuel to the wall surface cannot be stabilized instantaneously. Namely, by adopting the time-attenuation of the correction amount, the result of the correction is effectively utilized not only in the present injection cycle but also in a plurality of successive cycles, thus attaining a greater degree of conformity between the actual fuel injection rate and the rate demanded by the engine. FIG. 25 illustrates a fuel injection computing routine in the described embodiment. This routine is executed for each of a predetermined crank angle which is, in this case, 360° . In FIG. 25, the same reference numerals are used to denote the same blocks as those in FIG. 20 and detailed description of such blocks is omitted.

After computing the quantity FMWET of fuel attaching to the wall of the intake system, Step 240 is executed to determine the correction increment FAE in accordance with the following formula (24).

$$FAE = 0.2 \cdot FAE_{OLD} + FMWET - FMWET_{OLD} \quad (24)$$

where, $FAE_{OLD}$ represents a previously computed correction increment, while $FMWET_{OLD}$ represents the previously computed quantity of fuel attaching to the wall.

Thus, the previously computed quantity $FMWET_{OLD}$ is multiplied by 0.2. This means that the previous correction increment has been reduced by 80%, and 20% of the previous correction increment is taken into the determination of the present correction increment. The described method of attenuation is only illustrative and various methods are usable depending on the type of the engine. For instance, the attenuation may be effected by a predetermined amount in each predetermined period, instead of each predetermined crank angle, e.g., 360° , as in the described example.

In Step 242, the fuel injection period TAU is computed by making use of the basic fuel injection period, correction factor FK and the correction increment FA, as in the preceding embodiment. In Step 244, the correction increment FAE is stored in the RAM so as to be used as the previous correction increment $FAE_{OLD}$ in the next computing cycle. Similarly, the quantity FMWET is stored in the RAM so as to be used as the previous quantity $FMWET_{OLD}$ into the next computing cycle.

Figure 23:
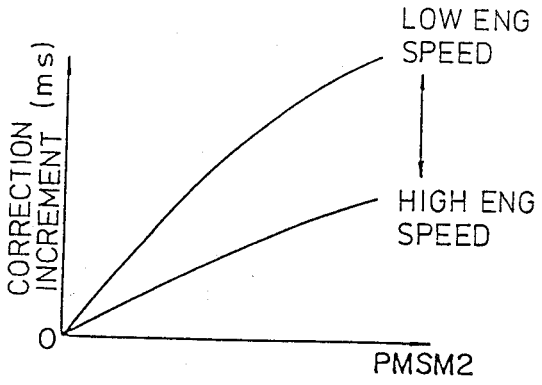

In the foregoing description taken in conjunction with FIG. 22, the quantity of the fuel attaching to the wall of the intake system is determined in accordance with the intake pressure on an assumption that the intake valve is fully closed. Actually, however, the quantity of the fuel attaching to the intake system wall varies also depending on the engine speed. The table determining the quantity of the attaching fuel, therefore, may be formed by employing two parameters: namely, the intake pressure and the engine speed, as shown in FIG. 23. The quantity of the attaching fuel further has a dependency on the engine temperature. The table, therefore, may further be modified to employ the engine temperature as a variable.

Although the prediction of the intake pressure in the described embodiments relies upon the weighted mean value, the prediction may be conducted in accordance with formula (16), or may by executed by processing the intake pressure during the steady state operation of the engine by a first-order time-lag element.

What is claimed is:

1. A method of controlling fuel injection rate in an internal combustion engine, comprising the steps of:

(a) computing a certain intake pressure at a certain time by using a steady-state intake pressure defined by an amount of actual throttle opening and actual engine rotational speed;

(b) computing a basic fuel injection period on the basis of the computed certain intake pressure and the actual engine rotational speed; and (c) controlling the fuel injection rate in accordance with the computed basic fuel injection period.

2. The method of controlling fuel injection rate in an internal combustion engine according to claim 1, wherein said certain intake pressure is calculated by treating the steady-state as pressure defined by an amount of the actual throttle opening and the actual engine rotational speed with a first order time-lag element.

3. The method of controlling fuel injection rate according to claim 1, wherein the certain intake pressure in said step (a) is calculated in accordance with the following formula:

$$P = \frac{b}{a} - \left(\frac{b}{a} - P_0\right)\exp$$

where

P is a certain intake pressure;

$$a = \frac{1}{2}\left[\frac{V_s}{V} \cdot \frac{NE}{60} \cdot \eta + \frac{RT\psi A}{V\sqrt{Pc - P_0}}\right];$$

$$b = \frac{RT}{V}\psi A\sqrt{Pc - P_0} - \frac{1}{2}\frac{V_s}{V} \cdot \frac{NE}{60} \cdot \eta P_0;$$

a/b=a steady-state intake pressure;

t is a period of time after a change in the amount of throttle opening;

V is a volume of air in the intake system from the throttle valve to the intake valve of said engine;

Vs is the stroke volume of said engine;

NE is a rotational speed of said engine;

$\eta$ is a suction efficiency of said engine;

R is the gas constant;

T is an absolute temperature of air in the intake system;

$\Psi$ is a flow rate coefficient;

A is an opening of the throttle valve;

Pc is the pressure of atmospheric air; and

Po is an intake pressure at a time t=0.

4. A method of controlling fuel injection rate in an internal combustion engine according to claim 1, further comprising the steps of:

(d) computing a basic ignition advance angle on the basis of the computed certain time intake pressure and the actual engine rotational speed; and (e) controlling an ignition timing on the basis of the computed basic ignition advance angle.

5. A method of controlling fuel injection rate in an internal combustion engine according to claim 1, wherein the certain time is a computing time of the basic fuel injection period or an intake valve closing time.

6. A method of controlling fuel injection rate in an internal combustion engine comprising:

(a) computing, at a predetermined frequency, a steady-state intake pressure on the basis of the amount of an actual throttle opening and an actual engine rotational speed;

(b) computing a weighting coefficient for use in calculating a weighted mean value;

(c) computing an actual weighted mean value of the intake pressure by weighting the weight of the weighted mean value of the intake pressure computed previously on the basis of a previously computed weighted mean value of the intake pressure, and the steady-state intake pressure, and the weighting coefficient;

(d) computing the basic fuel injection period on the basis of the actual weighted mean value of the intake pressure computed in the preceding step (c) and the actual engine rotational speed; and (e) controlling the fuel injection rate on the basis of the computed basic fuel injection period.

7. The method of controlling fuel injection rate in an internal combustion engine according to claim 6, wherein the computation of the actual weighted mean value of the intake pressure in step (c) is conducted in accordance with the following formula:

$$PMSM_i = \frac{(n-1) \cdot PMSM_{i-1} + PMTA}{n}$$

where $PMSM_i$ is actual weighted means value of the intake pressure;

$PMSM_{i-1}$ is the previously computed weighted mean value of the intake pressure;

PMTA is the steady-state intake pressure; and n is the weighting coefficient.

8. The method of controlling fuel injection rate in an internal combustion engine according to claim 6, wherein the computation of the weighting coefficient in step (b) is conducted on the basis of the time constant and the predetermined frequency.

9. The method of controlling fuel injection rate in an internal combustion engine according to claim 6, wherein the weighting coefficient in step (b) is conducted on the basis of the amount of the actual throttle opening and the actual engine rotational speed, or the steady-state intake pressure and the actual engine rotational speed.

10. A method of controlling fuel injection rate in an internal combustion engine according to claim 6, further comprising the steps of:

(f) computing a basic ignition advance angle on the basis of the actual weighted mean value of the intake pressure computed by step (c) and the actual engine rotational speed; and (g) controlling an ignition timing on the basis of the computed basic ignition advance angle.

11. A fuel injection rate control system of an internal combustion engine, comprising:

throttle opening amount detecting means for detecting an amount of a throttle opening;

engine speed detecting means for detecting an engine rotational speed;

intake pressure computing means for computing, at a predetermined frequency, a steady-state intake pressure on the basis of the detected amount of the actual throttle opening and the detected actual engine rotational speed;

intake pressure correction means for treating an output of the intake pressure computing means with an element of time lag of first order;

basic fuel injection period computing means for computing a basic fuel injection period on the basis of the intake pressure corrected by the intake pressure correction means and the detected actual engine rotational speed; and fuel injection rate control means for controlling an amount of fuel injection on the basis of the basic fuel injection period.

12. The fuel injection rate control system of an internal combustion engine according to claim 11, wherein said intake pressure correction means includes:

weighting coefficient computing means for using in computation of a weighted mean value;

weighted mean value computing means for computing the actual weighted mean value of the intake pressure by weighting the weight of the weighted mean value of the intake pressure computed previously on the basis of a previously computed weighted means value of the intake pressure, and the steady-state pressure, and the weighting coefficient obtained by the weighting coefficient computing means; and basic fuel injection period computing means for computing the basic fuel injection period on the basis of said weighted mean value computed by said weighted mean value computing means, and the detected actual engine rotational speed.

13. The fuel injection rate control system of an internal combustion engine according to claim 12, wherein said weighting coefficient computing means computes the weighting coefficient in accordance with the time constant relating to change in the intake pressure during the transient period and the computing period of computation performed by said intake pressure computing means.

14. The fuel injection rate control system of an internal combustion engine according to claim 12, further comprising predicting means for predicting an amount of change in the quantity of fuel attaching to an engine wall from the weighted mean value computed by said weighted mean value computing means said fuel injection rate control means being adapted to control the fuel injection rate on the basis of said basic fuel injection period and said amount of change in the quantity of the fuel attaching to the engine wall.

15. The fuel injection rate control system of an internal combustion engine according to claim 12, wherein said weighted means value computing means computes the weighting coefficient in accordance with the amount of the actual throttle opening and the detected actual engine rotational speed, or in accordance with the computed steady-state intake pressure and the detected actual engine rotational speed.

16. The fuel injection rate control system of an internal combustion engine according to claim 12, said intake pressure correction means being designed to predict, by employing a predetermined number of cycles of computation of said weighted mean value of said intake pressure performed by said weighted mean value computing means, the intake pressure to be obtained when said intake air flow rate is settled.

17. The fuel injection rate control system of an internal combustion engine according to claim 14, further comprising means for computing an amount of change in the quantity of the fuel attaching to the engine wall as a function of at least one of the engine temperature and the engine speed.

18. A fuel injection rate control system of an internal combustion engine according to claim 13, wherein said weighted mean value computing means predicts the intake pressure by repeating computation of the weighted mean value a number of predetermined times defined by the time from the actual time to the time of closing an intake valve, and the calculating period of calculating the steady-state intake pressure.

19. A fuel injection rate control system of an internal combustion engine according to claim 11, further comprising:

basic ignition advance angle computing means for computing a basic ignition advance angle on the basis of the intake pressure corrected by the intake pressure correction means, and the detected actual engine rotational speed; and ignition timing control means for controlling ignition timing on the basis of the basic ignition advance angle.

20. A fuel injection rate control system of an internal combustion engine according to claim 12, further comprising:

basic ignition advance angle computing means for computing a basic ignition advance angle on the basis of the weighted means value computed by the weighted mean value computing means, and the detected actual engine rotational speed; and ignition timing control means for controlling ignition timing on the basis of the basic ignition advance angle.

* * * * *